US011114008B2

(12) United States Patent
Jang et al.

(10) Patent No.: US 11,114,008 B2
(45) Date of Patent: Sep. 7, 2021

(54) DISPLAY DEVICE AND OPERATING METHOD THEREOF

(71) Applicant: AU OPTRONICS CORPORATION, Hsin-Chu (TW)

(72) Inventors: Shuo-Wen Jang, Hsin-Chu (TW); Hsin-Lin Hu, Hsin-Chu (TW); Jui-Chi Lo, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/934,202

(22) Filed: Jul. 21, 2020

(65) Prior Publication Data

US 2021/0027687 A1 Jan. 28, 2021

(30) Foreign Application Priority Data

Jul. 25, 2019 (TW) ..... 108126280

(51) Int. Cl.
*G09G 3/20* (2006.01)

(52) U.S. Cl.
CPC ..... *G09G 3/20* (2013.01); *G09G 3/2085* (2013.01); *G09G 2300/08* (2013.01); *G09G 2300/0804* (2013.01); *G09G 2310/0202* (2013.01); *G09G 2310/0275* (2013.01); *G09G 2310/0297* (2013.01)

(58) Field of Classification Search
CPC ..... G09G 3/2085; G09G 2300/0804; G09G 2310/0202; G09G 2310/0297
See application file for complete search history.

(56) References Cited

U.S. PATENT DOCUMENTS

| | | | | |
|---|---|---|---|---|
| 10,839,748 | B2 * | 11/2020 | Kim | G09G 3/3233 |
| 2005/0200617 | A1 * | 9/2005 | Kwak | G09G 3/3233 345/204 |
| 2006/0139257 | A1 * | 6/2006 | Kwak | G09G 3/3233 345/76 |
| 2010/0007591 | A1 | 1/2010 | Yen et al. | |
| 2016/0372043 | A1 * | 12/2016 | Yamanaka | G09G 3/3266 |
| 2017/0255049 | A1 | 9/2017 | Nishiyama et al. | |
| 2017/0372662 | A1 | 12/2017 | Zhang et al. | |
| 2019/0206324 | A1 * | 7/2019 | Kim | G09G 3/32 |

FOREIGN PATENT DOCUMENTS

| | | |
|---|---|---|
| TW | 201003621 | 1/2010 |
| TW | 201621875 | 6/2016 |
| TW | 201629939 | 8/2016 |

* cited by examiner

*Primary Examiner* — Gene W Lee
(74) *Attorney, Agent, or Firm* — WPAT, PC

(57) ABSTRACT

A display device is disclosed. The display device comprises: a plurality of data lines are configured to receive a plurality of data voltages from a source driver, wherein the source driver is disposed in a non-display area of the display device; and a first multiplex switch is disposed in a display area of the display device and configured in response to a first multiplex signal, to provide a first data voltage of the data voltages to a first data line of the data lines.

18 Claims, 6 Drawing Sheets

DISPLAY DEVICE AND OPERATING METHOD THEREOF

BACKGROUND

Technical Field

The present invention relates to an electronic device and a method, and in particular, the present invention relates to a display device and operating method thereof.

Related Art

With the rapid development of electronic technology, display devices such as mobile phones or computers have been widely used in people's lives.

In general, a display device can include a gate driver, a source driver, and a pixel circuit array. The gate driver can sequentially provide a plurality of gate signals to the pixel circuit, in order to turn on the data switch of the pixel circuit column by column. The source driver can provide a plurality of data voltages to the pixel circuit in which that the data switch is turning on, in order to make the pixel circuit conducting display operations according to the data voltage.

SUMMARY

An embodiment of the present invention relates to a display device. According to an embodiment of the present invention, a display device comprises: a plurality of data lines, configured to receive a plurality of data voltages from a source driver, wherein the source driver is disposed in a non-display area of the display device; and a first multiplex switch disposed in a display area of the display device and configured in response to a first multiplex signal, to provide a first data voltage of the data voltages to a first data line of the data lines.

Another embodiment of the present invention is related to an operating method of display device. According to an embodiment of the present invention, the operating method of a display device comprises: providing a plurality of data voltages from a source driver, wherein the source driver is disposed in a non-display area of the display device; and through a first multiplex switch disposed in a display area of the display device, providing a first data voltage of the data voltages to a first data line in response to a first multiplex signal.

Another embodiment of the present invention relates to a display device. According to an embodiment of the present invention, the display device comprises: a plurality of data lines, disposed substantially parallel to each other; a plurality of gate lines disposed substantially parallel to each other; a plurality of data switches, respectively electrically connected between the data lines and a plurality of pixel electrodes, and configured to be turned on according to a plurality of gate signals provided by the gate lines; and a plurality of multiplex switches, disposed in a display area of the display device for respectively providing a plurality of data voltages to different ones of the data lines.

By applying the above embodiment, the multiplex switch can be disposed in the display area to achieve the effect of reducing the frame

BRIEF DESCRIPTION OF THE DRAWINGS

In order to make the above and other objects, features, advantages and embodiments of the present invention more clearly and easily understood, the descriptions of the attached figures are as follows.

DETAILED DESCRIPTION

The spirit of the present invention will be clearly described in the following schematic and detailed description. Any person with ordinary skills in the art who understands the embodiment of the disclosed content can change and modify the technology taught by the present invention, which is not separated from the spirit and scope of the present invention.

Regarding the "first", "second", . . . , etc., as used herein, it does not specifically refer to the meaning of order or sequence, nor is it used to define the invention, but only to distinguish elements or operations described in the same technical terms.

As for the "electrical connection" used herein, it can refer to two or more elements making physical or electrical contact with each other directly or indirectly, and "electrical connection" can also refer to two or more elements operating or acting with each other.

The terms "including", "comprising", "having", "containing", etc., as used herein are all open terms, which is meaning to include but not to limit.

About the "and/or", as used herein, it is meant to include any or all combinations of the recited things.

About the "substantially", "approximately", and so on, as used herein, are used to modify the quantity or error of any slight variation, but such slight variations or errors do not alter the nature.

Unless otherwise specified, the terms used in this paper usually have the common meaning of each word in the art, in the present invention content and the special content. Some terms used to describe the present invention will be discussed below or elsewhere in this specification to provide additional guidance for those skilled in the art on the description of the present invention.

Figure 1:
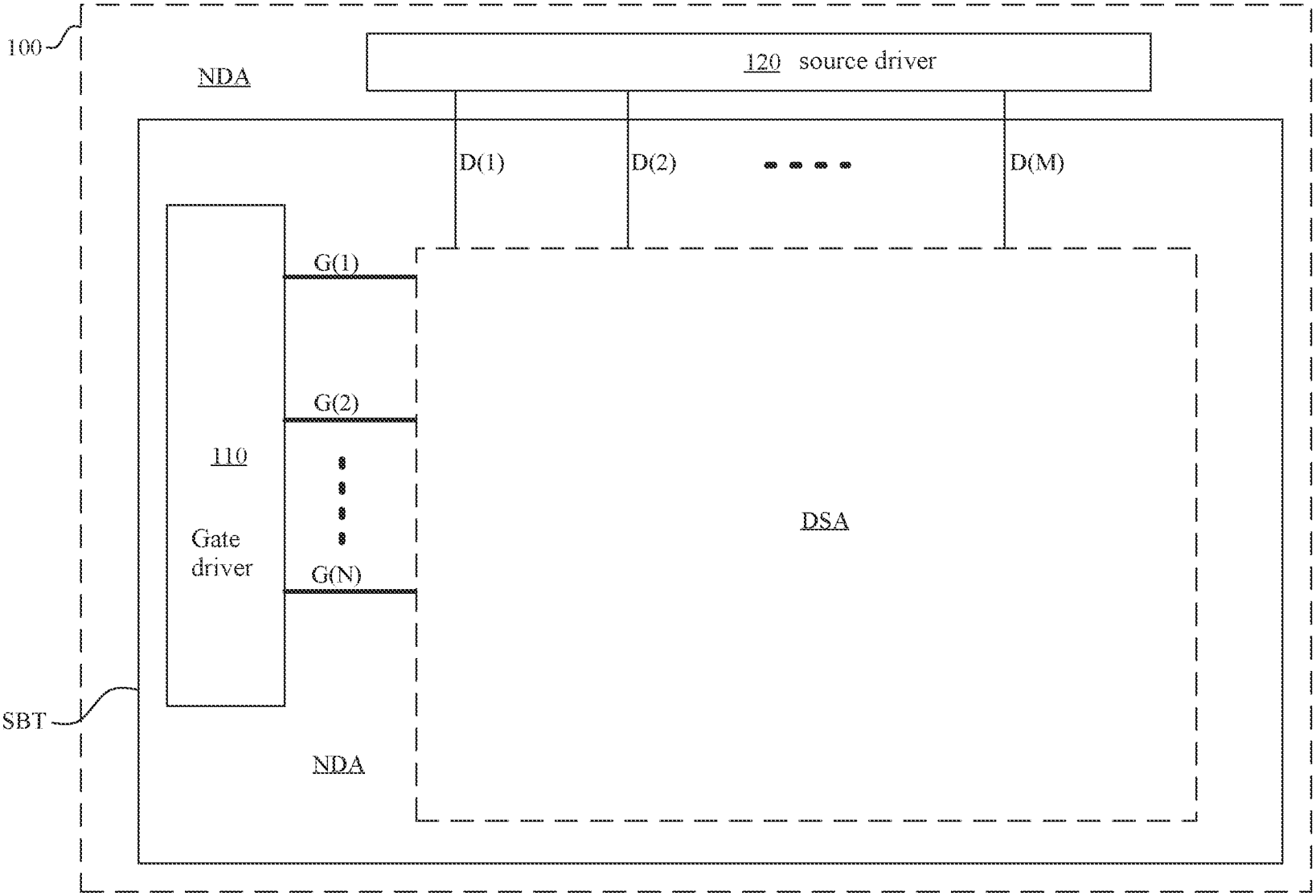
FIG. 1 is a schematic diagram of a display device in accordance with an embodiment of the present invention.

FIG. 1 is a schematic diagram of a display device 100 in accordance with an embodiment of the present invention. The display device 100 may include a gate driver 110, a source driver 120, and a substrate SBT. The display device 100 has a display area DSA and a non-display area NDA. The gate driver 110 and the source driver 120 are both disposed in the non-display area NDA of the display device 100.

In the present embodiment, the gate driver 110 can generate a plurality of gate signals respectively and provide them to the data switches (e.g., the data switches T11-T36 in FIG. 2) located in the display area DSA by a plurality of gate lines G(1), . . . , G(N) to turned on them. The source driver 120 can generate a plurality of data voltages, and provide the data voltages to the corresponding pixel electrodes through the plurality of data lines D(1), . . . , D(M) to update the data voltages on the pixel electrodes, where N is natural number, M is a natural number.

Figure 2:
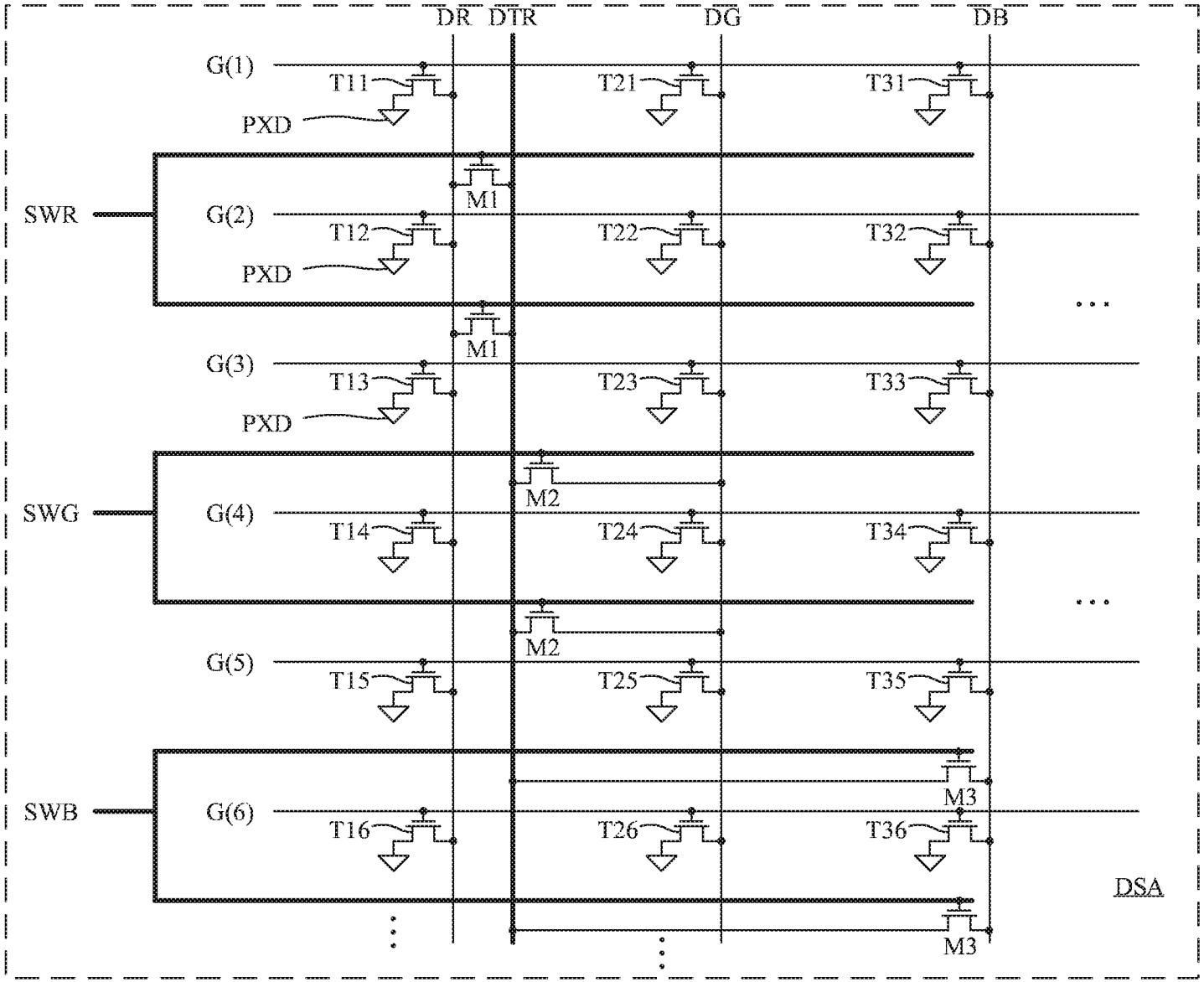
FIG. 2 is a schematic diagram of a multiplex switch, a multiplex signal, and data transmission line in accordance with an embodiment of the present invention.

Referring to FIG. 2, in an embodiment of the present invention, the display device 100 further includes data switches T11-T36, multiplex switches M1-M3, and pixel electrodes PXD (represented only by inverted triangle symbol). In one embodiment, the data switches T11-T36, the multiplex switches M1-M3, and the pixel electrodes PXD are all disposed in the display area DSA of the display device 100. It should be noted that although in this present invention is taken each two multiplex switches M1-M3 as an example to explain, in different embodiments, the number of each multiplex switches M1-M3 can be adjusted according to actual needs (such as one, three, or other numbers), and therefore are not limited to the described in the embodiment. In addition, although the multiplexes switches M1-M3 of three different setting modes is taken as an example to explain in the present invention, in different embodiments, the number of types of the multiplexed switch can be adjusted according to actual conditions (for example, 2 types, 4 types, or other number types), and therefore are not limited to the described in the embodiment.

In one embodiment, the display device 100 further multiple data lines DR, DG, DB, and a data transmission line DTR (also referred to as a data line DTR). In an embodiment, the data lines DR, DG, DB, and the data transmission line DTR are disposed substantially parallel to each other. In an embodiment, the data transmission line DTR may be one of the aforementioned data lines D(1), . . . , D(M). In another embodiment, the data transmission line DTR is electrically connected to one of the aforementioned data lines D(1), . . . , D(M).

In one embodiment, the display device 100 further includes a multiplex signal line SWR, SWG, and SWB. In one embodiment, the multiplex signal lines SWR, SWG, SWB are substantially parallel to the gate lines G(1), . . . , G(N). In an embodiment, the multiplex signal lines SWR, SWG, and SWB can be disposed between the gate lines G(1), . . . , G(N). From another perspective, the multiplex signal lines SWR, SWG, and SWB can be interleaving disposed with the gate lines G(1), . . . , G(N). In one embodiment, the multiplex signal lines SWR, SWG, SWB can receive multiplex signals that came from a multiplex signal generator (not shown). In one embodiment, the multiplexed signal generator, for example, can be implemented by a circuit or a timing controller, but not limited thereto.

In one embodiment, the multiplex switch M1 is electrically connected between the data transmission line DTR and the data line DR, and the control end of the multiplex switch M1 is electrically connected to the multiplex signal line SWR. The multiplex switch M1 is turned on according to the multiplex signal from the multiplex signal line SWR to provide the data voltage from the data transmission line DTR to the data line DR.

In one embodiment, the multiplex switch M2 is electrically connected between the data transmission line DTR and the data line DG, and the control end of the multiplex switch M2 is electrically connected to the multiplex signal line SWG. The multiplex switch M2 is turned on according to the multiplex signal from the multiplex signal line SWG to provide the data voltage from the data transmission line DTR to the data line DG.

In one embodiment, the multiplex switch M3 is electrically connected between the data transmission line DTR and the data line DB, and the control end of the multiplex switch M3 is electrically connected to the multiplex signal line SWB. The multiplex switch M3 is turned on according to the multiplex signal from the multiplex signal line SWB to provide the data voltage from the data transmission line DTR to the data line DB.

In one embodiment, the multiplex switches M1-M3 are alternatively turned on to provide data voltages that came from the data transmission line DTR to the data lines DR, DG, DB, respectively.

In one embodiment, the data switches T11-T16 are electrically connected between the data lines DR and the pixel electrode PXD, and the control end of the data switches T11-T16 is respectively electrically connected to the gate line G(1)-G(6). The data switches T11-T16 are respectively turned on according to the gate signals from the gate lines G(1)-G(6) to respectively provide the data voltages on the data lines DR to the corresponding pixel electrodes PXD.

In one embodiment, the data switches T21-T26 are electrically connected between the data line DG and the pixel electrode PXD, and the control end of the data switches T21-T26 is electrically connected to the gate line G(1)-G(6). The data switches T21-T26 are respectively turned on according to the gate signals from the gate lines G(1)-G(6) to respectively provide the data voltages on the data lines DG to the corresponding pixel electrodes PXD.

In one embodiment, the data switches T31-T36 are electrically connected between the data line DB and the pixel electrode PXD, and the control end of the data switches T31-T36 is electrically connected to the gate line G(1)-G(6). The data switches T31-T36 are respectively turned on according to the gate signals from the gate lines G(1)-G(6) to respectively provide the data voltages on the data lines DB to the corresponding pixel electrodes PXD.

With the above setting, the multiplex switches M1-M3 can be disposed in the display area DSA, and the multiplex switch can be prevented from being disposed in the non-display area NDA, thereby achieving the effect of reducing the frame.

In one embodiment, the multiplex switches M1-M3 are located substantially between the data switches. For example, the multiplex switch M1 is located substantially between the data switches T11-T23, and the multiplex switch M2 is located substantially between the data switches T13-T25.

In one embodiment, each multiplex switch M1-M3 is located substantially between two adjacent data lines DR, DG, DB. For example, the multiplex switch M1 is located substantially between the data lines DR and DG, the multiplex switch M2 is located substantially between the data lines DR, DG, and the multiplex switch M3 is located substantially between the data lines DG and DB.

In one embodiment, each multiplex switch M1-M3 is located substantially between two adjacent gate lines. For example, the multiplex switch M1 closer to the gate line G(1) is located substantially between the gate lines G(1)-G(2), and the multiplex switch M2 closer to the gate line G(5) is located substantially between the gate lines G(4)-G(5).

In one embodiment, each multiplex switch M1-M3 is substantially surrounded by two adjacent gate lines and two adjacent data lines. For example, the multiplex switch M1 closer to the gate line G(1) is substantially surrounded by the gate lines G(1)-G(2) and the data lines DR, DG, and the multiplex switch M2 closer to the gate line G(5) is substantially surrounded by the gate lines G(4)-G(5) and the data lines DR, DG.

It should be noted that the setting position of the multiplex switch M1-M3 can be adjusted according to actual needs, and are not limited to the above implementation.

The term "between" or "surrounded by" in this context can be understood to mean that the orthographic projection of the component on the substrate SBT is substantially located between the orthographic projection of the other component on the substrate SBT, or the orthographic projection of the component on the substrate SBT is substantially surrounded by the orthographic projection of other elements on the substrate SBT.

In one embodiment, multiple gate lines may be spaced between the multiplex signal lines SWR, SWG and SWB. In one embodiment, the multiplex signal lines SWR, SWG and SWB are approximately evenly arranged in the display area DSA. For example, when the resolution of the display device 100 is 1920*1080, the multiplex signal lines SWR, SWG and SWB can be respectively disposed approximately at the positions of the first gate line, the 361st gate line, and 721st gate line counting from the top.

By evenly distributing the positions of the multiplex signal lines SWR, SWG, and SWB, the problem of uneven aperture ratio can be avoided.

Figure 3:
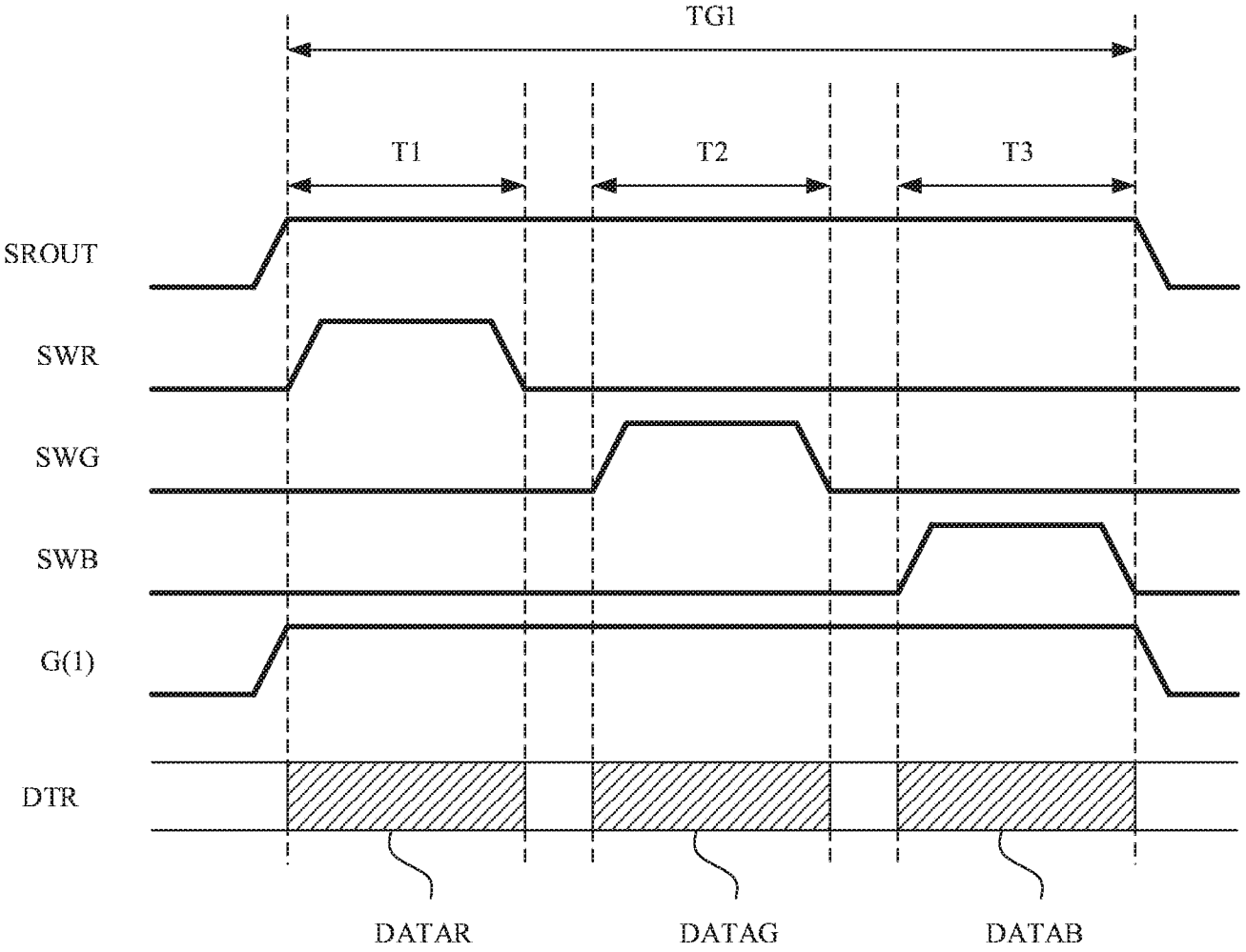
FIG. 3 is a signal diagram in accordance with an embodiment of the present invention.

The details in the embodiment of the present invention will be further described below in combination with FIG. 3, but the present invention is not limited to the embodiments described below.

In the period TG1, the source driver 120 corresponding to the drive signals SROUT, sequentially provides data voltage DATAR, DATAG, DATAB to the data transmission line DTR. Besides, in the period TG1, the gate driver 110 provides the gate signal with a first voltage level (e.g., high voltage level) to the gate line G (1).

Further, in the period T1, the source driver 120 provides the data voltage DATAR to the data transmission line DTR. At this time, the multiplex switch M1 corresponding to the multiplex signal with the second voltage level (such as the high voltage level) (which may be the same or different from the first voltage level) on the multiplex signal line SWR is turned on to provide the data voltage DATAR on the transmission line DTR to the data line DR. At this time, the data switch T11 corresponding to the gate signal with the first voltage level on the gate line G(1) is turned on to provide the data voltage DATAR on the data line DR to the corresponding pixel electrode PXD.

On the other hand, in the period T1, the multiplex switches M2 and M3 corresponding to the multiplex signal with the third voltage level (such as the low voltage level) (below the second voltage level) on the multiplex signal lines SWG and SWB is turned off to avoid providing the data voltage DATAR on the data transmission line DTR to the data lines DG, DB.

In the period T2, the source driver 120 provides the data voltage DATAG to the data transmission line DTR instead. At this time, the multiplex switch M2 corresponding to the multiplex signal with the second voltage level on the multiplex signal line SWR is turned on to provide the data voltage DATAG on the data transmission line DTR to the data line DG. At this time, the data switch T21 corresponding to the gate signal with the first voltage level on the gate line G(1) is turned on to provide the data voltage DATAG on the data line DG to the corresponding pixel electrode PXD.

On the other hand, in the period T2, the multiplex switches M1 and M3 corresponding to the multiplex signal with the third voltage level on the multiplex signal lines SWR and SWB are turned off to avoid providing the data voltage DATAG on the data transmission line DTR to the data line DR, DB.

In the period T3, the source driver 120 provides the data voltage DATAB to the data transmission line DTR instead. At this time, the multiplex switch M3 corresponding to the multiplex signal with the second voltage level on the multiplex signal line SWR is turned on to provide the data voltage DATAB on the data transmission line DTR to the data line DB. At this time, the data switch T31 corresponding to the gate signal with the first voltage level on the gate line G(1) is turned on to provide the data voltage DATAB on the data line DB to the corresponding pixel electrode PXD.

On the other hand, in the period T3, the multiplex switches M1 and M2 corresponding to the multiplex signal with the third voltage level on the multiplex signal lines SWR and SWG are turned off to avoid providing the data voltage DATAB on the data transmission line DTR to the data line DR, DG.

By the above operation, the display device 100 can update the data voltage on the pixel electrode PXD by the multiplex switches M1-M3 provided in the display area DSA.

Figure 4:
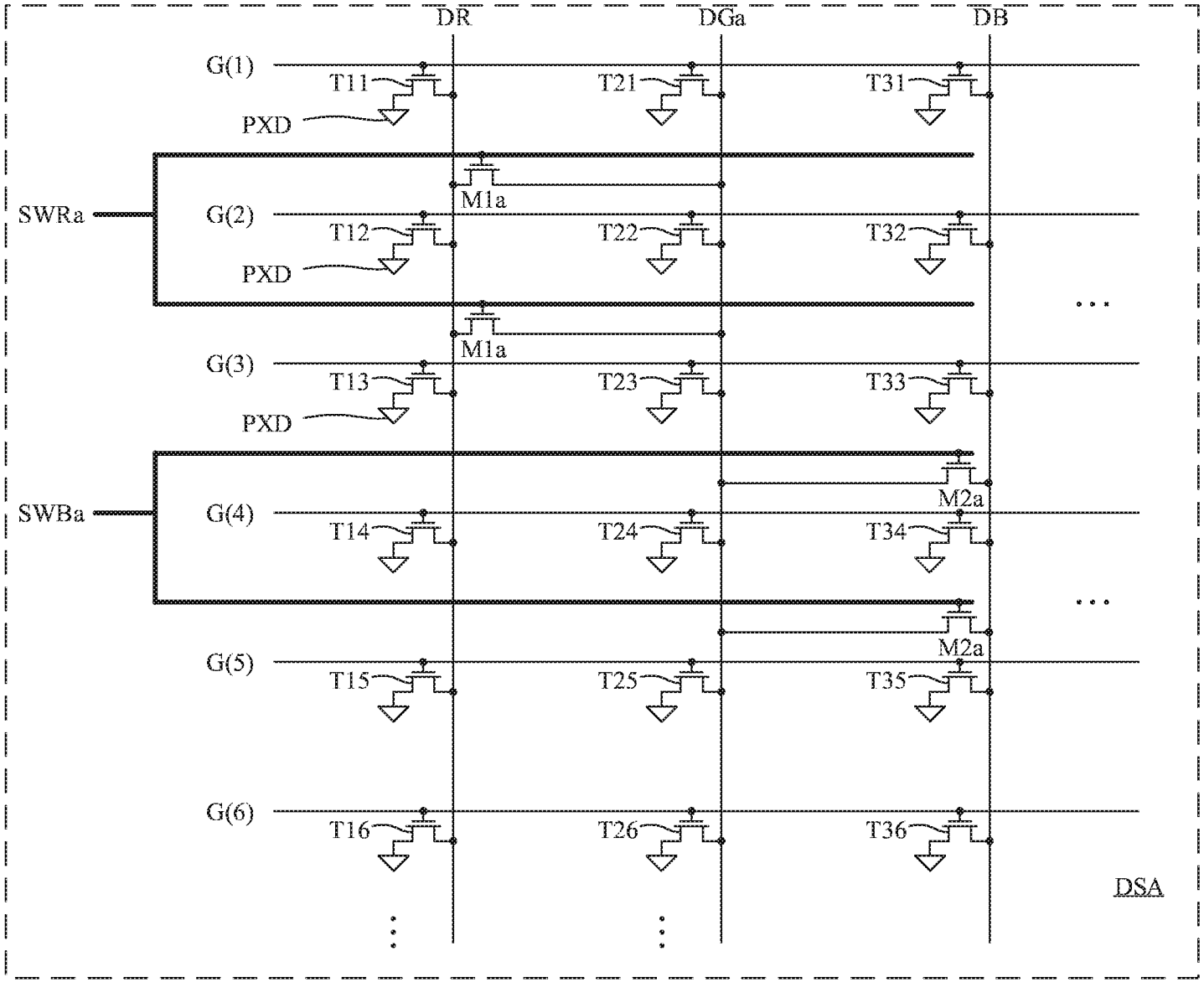
FIG. 4 is a schematic diagram of a multiplex switch, a multiplex signal, and a data line in accordance with an embodiment of the present invention.
Figure 5:
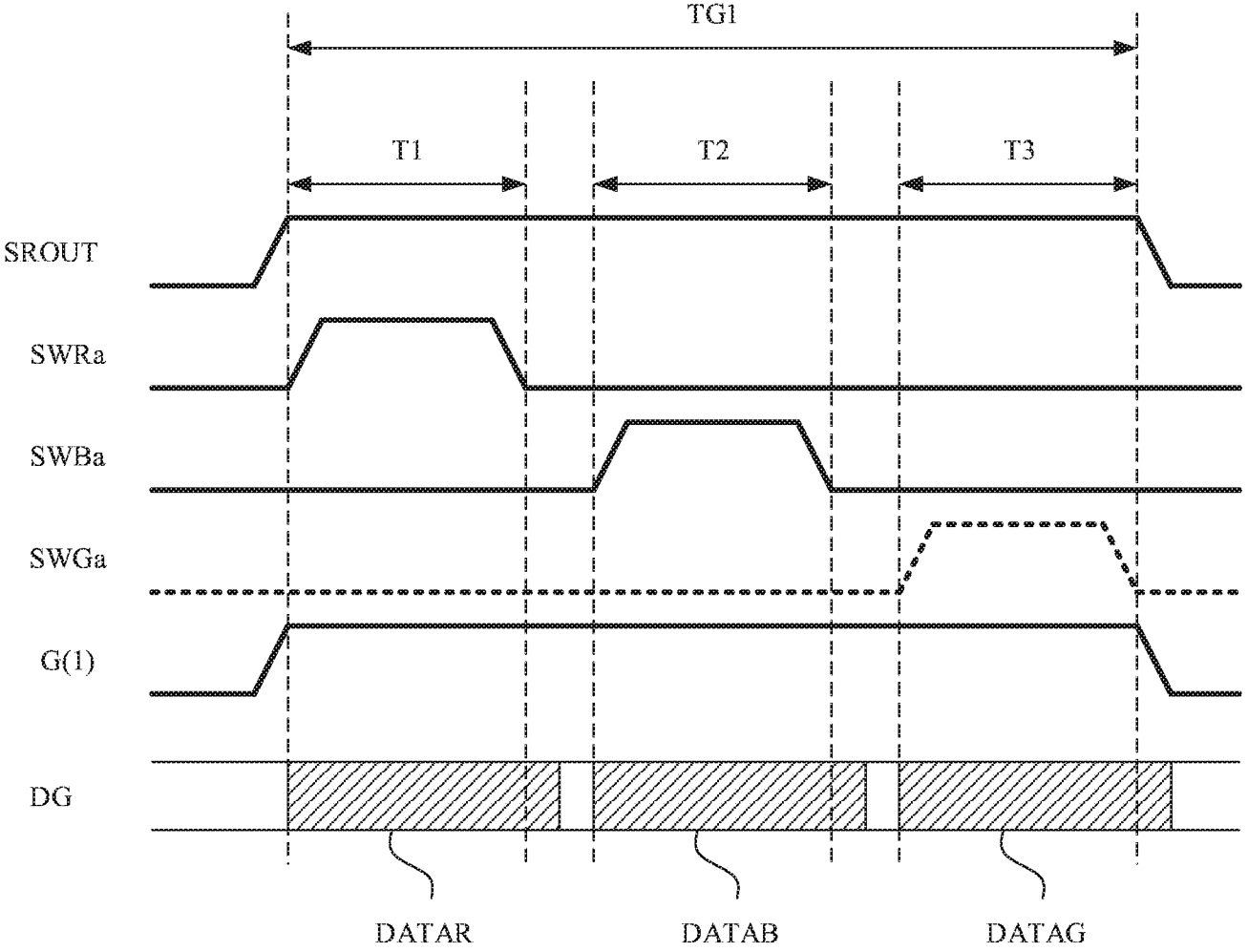
FIG. 5 is a signal diagram in accordance with an embodiment of the present invention.

The details in another embodiment of the present invention are provided below in combination with FIGS. 4, 5, however, the present invention is not limited to the content of the embodiments described below. It should be noted that the display devices of the embodiments corresponding to FIGS. 4, 5 are substantially the same as the display devices of the embodiments corresponding to FIGS. 1-3, and thus the repeated parts will not be described again.

In one embodiment of the present invention, the display device 100 not only comprises a gate driver 110, a source driver 120, and a substrate SBT, but also data switches T11-T36, multiplex switches M1*a*-M2*a*, and the pixel electrodes PXD (represented only by inverted triangle symbol). In one embodiment, the data switches T11-T36, the multiplex switches M1-M3, and the pixel electrodes PXD are all disposed in the display area DSA of the display device 100. It should be noted that although in this present invention is taken each two multiplex switches M1*a*-M2*a* as an example to explain, in different embodiments, the number of each multiplex switches M1*a*-M2*a* can be adjusted according to actual needs (such as one, three, or other numbers), and therefore are not limited to the described in the embodiment. In addition, although the multiplex switches M1*a*-M2*a* of two different setting modes is taken as an example to explain in the present invention, in different embodiments, the number of types of the multiplex switch can be adjusted according to actual conditions (for example, 3 types, 4 types, or other number types), and therefore are not limited to the described in the embodiment.

In one embodiment, the display device 100 further comprises multiple data lines DR, DGa, and DB. In one embodiment, the data lines DR, DGa, and DB are disposed substantially parallel to each other. In one embodiment, the data line DGa may be one of the aforementioned data lines D(1), . . . , D(M). In another embodiment, the data line DGa is electrically connected to one of the aforementioned data lines D(1), . . . , D(M).

In one embodiment, the display device 100 further comprises multiplex signal lines SWRa, SWBa. In one embodiment, the multiplex signal lines SWRa, SWBa are substantially parallel to the gate lines G(1), . . . , G(N). In one embodiment, the multiplex signal lines SWRa, SWBa may be disposed between the gate lines G(1), . . . , G(N). From another perspective, the multiplex signal lines SWRa, SWBa can be interleaving disposed with the gate lines G(1), . . . , G(N). In one embodiment, the multiplex signal lines SWRa, SWBa can receive multiplex signals that came from a multiplex signal generator (not shown). In one embodiment, the multiplex signal generator, for example, can be implemented by a circuit or a timing controller, but not limited thereto.

In one embodiment, the multiplex switch M1*a* is electrically connected between the data line DGa and the data line DR, and the control end of the multiplex switch M1*a* is electrically connected to the multiplex signal line SWRa. The multiplex switch M1*a* is turned on according to the multiplex signal from the multiplex signal line SWRa to provide the data voltage from the data line DGa to the data line DR.

In an embodiment, the multiplex switch M2*a* is electrically connected between the data line DGa and the data line DB, and the control end of the multiplex switch M2*a* is electrically connected to the multiplex signal line SWBa. The multiplex switch M2*a* is turned on according to the multiplex signal from the multiplex signal line SWBa to provide the data voltage from the data line DGa to the data line DB.

In one embodiment, the multiplex switches M1*a*, M2*a* are alternatively turned on to provide data voltages that came from the data line DGa to the data lines DR, DB, respectively.

With the above setting, the multiplex switches M1*a*, M2*a* can be disposed in the display area DSA, and the multiplex switch can be prevented from being disposed in the non-display area NDA, thereby achieving the effect of reducing the frame.

In one embodiment, the multiplex switches M1*a*, M2*a* are located substantially between the data switch. For example, the multiplex switch M1*a* is located substantially between the data switches T11-T23, and the multiplex switch M2*a* is located substantially between the data switches T33-T35.

In one embodiment, each multiplex switch M1*a*, M2*a* is located substantially between two adjacent data lines DR, DGa, DB. For example, the multiplex switch M1*a* is located substantially between the data lines DR and DGa, and the multiplex switch M2*a* is located substantially between the data lines DGa and DB.

In one embodiment, each multiplex switch M1*a*, M2*a* is located substantially between two adjacent gate lines. For example, the multiplex switch M1*a* closer to the gate line G(1) is located substantially between the gate lines G(1)-G(2), and the multiplex switch M2*a* closer to the gate line G(5) is located substantially between the gate lines G(4)-G(5).

In one embodiment, each multiplex switches Mia, M2*a* is substantially surrounded by two adjacent gate lines and two adjacent data lines. For example, the multiplex switch M1*a* closer to the gate line G(1) is substantially surrounded by the gate lines G(1)-G(2) and the data lines DR, DGa, and the multiplex switch M2*a* closer to the gate line G(5) is substantially surrounded by the gate lines G(4)-G(5) and the data lines DR, DGa.

It should be noted that the setting positions of the multiplex switch M1*a* and M2*a* can be adjusted according to actual needs, and are not limited to the above implementation.

In one embodiment, multiple gate lines may be spaced between the multiplex signal lines SWRa and SWBb. In one embodiment, the multiplex signal lines SWRa and SWBa are substantially evenly disposed in the display area DSA. For example, when the resolution of the display device 100 is 1920*1080, the multiplex signal lines SWRa, SWBa can be respectively disposed substantially at the position of the first gate line and the 541st gate line counting from the top.

By evenly distributing the positions of the multiplex signal lines SWRa and SWBa, the problem of uneven aperture ratio can be avoided.

The details in the embodiment of the present invention will be further described below in combination with FIG. 4, but the present invention is not limited to the embodiments described below.

In the TG1 period, the source driver 120 corresponding to the drive signals SROUT, sequentially provides data voltage DATAR, DATAG, DATAB to the data line DGa. Besides, in the TG1 period, the gate driver 110 provides the gate signal with a first voltage level (e.g., high voltage level) to the gate line G (1).

Further, in the period T1, the source driver 120 provides the data voltage DATAR to the data line DGa. At this time, the multiplex switch M1*a* corresponding to the multiplex signal with the second voltage level (such as the high voltage level) (which may be the same or different from the first voltage level) on the multiplex signal line SWRa is turned on to provide the data voltage DATAR on the data line DGa to the data line DR. At this time, the data switch T11 corresponding to the gate signal with the first voltage level on the gate line G(1) is turned on to provide the data voltage DATAR on the data line DR to the corresponding pixel electrode PXD.

On the other hand, in the period T1, the multiplex switch M2*a* corresponding to the multiplex signal with the third voltage level (such as the low voltage level) (below the second voltage level) on the multiplex signal line SWBa is turned off to avoid providing the data voltage DATAR on the data line DGa to the data line DB. In different embodiments, in the period T1, the multiplexer M2*a* can also be turned on.

In the period T2, the source driver 120 provides the data voltage DATAB to the data line DGa instead. At this time, the multiplex switch M2*a* corresponding to the multiplex signal with the second voltage level on the multiplex signal line SWBa is turned on to provide the data voltage DATAB on the data line DGa to the data line DB. At this time, the data switch T31 corresponding to the gate signal with the first voltage level on the gate line G(1) is turned on to provide the data voltage DATAB on the data line DB to the corresponding pixel electrode PXD.

On the other hand, in the period T2, the multiplex switch M1*a* corresponding to the multiplex signal with the third voltage level (such as the low voltage level) (below the second voltage level) on the multiplex signal line SWRa is turned off to avoid providing the data voltage DATAB on the data line DGa to the data line DR.

In the period T3, the source driver 120 provides the data voltage DATAG to the data line DGa instead. At this time, the data switch T21 corresponding gate signal with the first voltage level (1) on the gate line G(1) is turned on to provide the data voltage DATAG on the data line DGa to the corresponding pixel electrode PXD. It should be noted that since the data line DGa is used as the data transmission line in this embodiment, the multiplex signal line SWGa and the multiplex signal thereon can be omitted (indicated by a broken line in FIG. 5).

In this time, the multiplex switches M1*a* and M2*a* corresponding to the multiplex signal with the third voltage level on the multiplex signal lines SWRa and SWGa are turned off to avoid providing the data voltage DATAG on the data line DGa to the data line DR.

By the above operation, the display device 100 can update the data voltage on the pixel electrode PXD by the multiplex switches M1*a*-M2*a* provided in the display area DSA.

Figure 6:
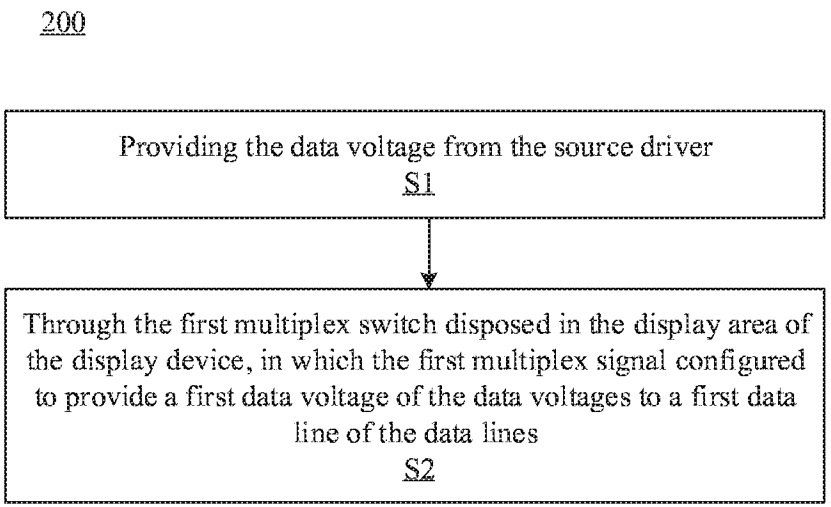
FIG. 6 is a flowchart of the operating method in accordance with an embodiment of the present invention.

FIG. 6 is a flowchart of the operation method 200 in accordance with an embodiment of the present invention. Wherein, the operation method 200 can be applied to a display device that is the same or similar to the structure shown in FIGS. 1 and 2. To simplify the description, according to one embodiment of the present invention, the operation method 200 will be described with the display device 100 in the FIGS. 1 and 2 as an example, however, the present invention is not limited to this application.

In addition, it should be understood that the operation sequence of the operation method 200 mentioned in the present embodiment can be adjusted according to actual needs, except the sequence is specially stated, and can even be performed simultaneously or partially simultaneously.

Moreover, such operations may also be adaptively added, replaced, and/or omitted in various embodiments.

In the present embodiment, the operation method 200 comprises the following operations.

In operation S1, the display device 100 is configured to provide a plurality of data voltages from the source driver 120, wherein the source driver 120 is disposed in the non-display area NDA of the display device 100.

In operation S2, the display device 100 is configured to provide the first data voltage in the previous data voltages to the data line DR through the first multiplex switch M1 disposed in the display area DSA corresponding to the first multiplex signal.

The specific details of the above operations can be referred to the foregoing paragraphs, and thus will not be described herein.

Although the present invention has been disclosed in the above embodiments, it is not intended to limit the present invention. Any person who is skilled in the art can make various alterations and modifications without departing from the spirit and scope of the present invention. Therefore, the scope of protection of the present invention shall be determined by the scope of the patent application claims attached hereto.

What is claimed is:

1. A display device, comprising:

a plurality of data lines, configured to receive a plurality of data voltages from a source driver, wherein the source driver is disposed in a non-display area of the display device;

a first multiplex switch disposed in a display area of the display device and configured in response to a first multiplex signal, to provide a first data voltage of the data voltages to a first data line of the data lines; and a plurality of data switches, respectively electrically connected between the data lines and a plurality of pixel electrodes for respectively providing the data voltages to the pixel electrodes;

wherein, the first multiplex switch is located among the data switches.

2. The display device according to claim 1, further comprising:

a second multiplex switch, configured in response to a second multiplex signal, to provide a second data voltage of the data voltages to a second data line.

3. The display device according to claim 2, wherein the first multiplex switch and the second multiplex switch are alternately turned on.

4. The display device according to claim 1, wherein the data switches are electrically connected to a plurality of gate lines, and wherein the first multiplex switch is located between adjacent two of the gate lines.

5. The display device according to claim 1, wherein the data switches are electrically connected to a plurality of gate lines, and a multiplex signal line configured to provide the first multiplex signal is located among the gate lines.

6. A display device, comprising:

a plurality of data lines, configured to receive a plurality of data voltages from a source driver, wherein the source driver is disposed in a non-display area of the display device; and a first multiplex switch disposed in a display area of the display device and configured in response to a first multiplex signal, to provide a first data voltage of the data voltages to a first data line of the data lines; and a data voltage transmission line substantially parallel to the data lines;

wherein, the first multiplex switch is disposed between the data voltage transmission line and the first data line, and is configured to provide the first data voltage from the data voltage transmission line to the first data line.

7. A display device, comprising:

a plurality of data lines, configured to receive a plurality of data voltages from a source driver, wherein the source driver is disposed in a non-display area of the display device; and a first multiplex switch disposed in a display area of the display device and configured in response to a first multiplex signal, to provide a first data voltage of the data voltages to a first data line of the data lines;

wherein the first multiplex switch is disposed between the first data line and a third data line of the data lines, and is configured to provide the first data voltage from the third data voltage line to the first data line.

8. An operating method of a display device, comprising:

providing a plurality of data voltages from a source driver, wherein the source driver is disposed in a non-display area of the display device;

through a first multiplex switch disposed in a display area of the display device, providing a first data voltage of the data voltages to a first data line in response to a first multiplex signal; and through a plurality of data switches, the data voltages configured to respectively provide the data voltages to the plurality of pixel electrodes, wherein the first multiplex switch is located among the data switches.

9. The operating method according to claim 8, further comprising:

through a second multiplex switch disposed in a display area of the display device, providing a second data voltage of the data voltage to a second data line in response to a second multiplex signal.

10. The operating method according to claim 9, wherein the first multiplex switch and the second multiplex switch are configured to provide the first data voltage alternately to the first data line and provide the second data voltage to the second data line.

11. The operating method according to claim 8, wherein the data switches are electrically connected to a plurality of gate lines, and wherein the first multiplex switch is located between adjacent two of the gate lines.

12. The operating method according to claim 8 further comprising:

through a multiplex signal line, providing the first multiplex signal;

wherein, the data switches are electrically connected to the plurality of gate lines, and the multiplex signal lines are located among the gate lines.

13. An operating method of a display device, comprising:

providing a plurality of data voltages from a source driver, wherein the source driver is disposed in a non-display area of the display device; and through a first multiplex switch disposed in a display area of the display device, providing a first data voltage of the data voltages to a first data line in response to a first multiplex signal;

wherein the operation of providing the first data voltage to the first data line comprises:

through the first multiplex switch, the first data voltage from a data voltage transmission line is provided to the first data line, wherein the data voltage transmission line is substantially parallel to the data lines, and the first multiplex switch is disposed between the data voltage transmission line and the first data line.

14. An operating method of a display device, comprising:

providing a plurality of data voltages from a source driver, wherein the source driver is disposed in a non-display area of the display device; and through a first multiplex switch disposed in a display area of the display device, providing a first data voltage of the data voltages to a first data line in response to a first multiplex signal;

wherein the operation of providing the first data voltage to the first data line comprises:

through the first multiplex switch, the first data voltage from a third data line of the data lines is provided to the first data line, wherein the first multiplex switch is disposed between the first data line and the third data line.

15. A display device comprising:

a plurality of data lines disposed substantially parallel to each other;

a plurality of gate lines disposed substantially parallel to each other;

a plurality of data switches respectively electrically connected between the data lines and a plurality of pixel electrodes, and configured to be turned on according to a plurality of gate signals provided by the gate lines; and a plurality of multiplex switches disposed in a display area of the display device for respectively providing a plurality of data voltages to different ones of the data lines.

16. The display device according to claim 15, further comprising:

a data voltage transmission line substantially parallel to the data lines;

wherein, the multiplex switches are respectively electrically connected between the data voltage transmission line and the data lines, and respectively configured to provide the data voltages from the data voltage transmission lines to different ones of the data lines.

17. The display device according to claim 15, wherein the multiplex switches are respectively electrically connected between the data lines to provide a first part of the data voltages from a first one of the data lines to a second one of the data lines, and to provide a second part of the data voltages from the first one of the data lines to a third one of the data lines.

18. The display device according to claim 15, wherein one of the multiplex switches is disposed between two adjacent data lines and two adjacent the gate lines.

* * * * *